United States Patent [19]

Stawicki

[11] Patent Number: 4,543,155

[45] Date of Patent: Sep. 24, 1985

[54] METHOD FOR BLEACHING WOOD PULP INCLUDING DISSOLVING OXYGEN INTO THE DILUTION WATER OF AN EXTRACTION STAGE

[75] Inventor: Robert J. Stawicki, Basking Ridge, N.J.

[73] Assignee: The BOC Group, Inc., Montvale, N.J.

[21] Appl. No.: 462,645

[22] Filed: Jan. 31, 1983

[51] Int. Cl.[4] ..... D21C 9/06; D21C 9/10; D21C 9/14

[52] U.S. Cl. ..... 162/57; 162/60; 162/65; 162/89

[58] Field of Search ..... 162/57, 60, 65, 90, 162/88, 89

[56] References Cited

U.S. PATENT DOCUMENTS

| | | | |
|---|---|---|---|
| 3,884,752 | 5/1975 | Campbell et al. | 162/89 |
| 3,966,542 | 6/1976 | Oldshue | 162/65 |
| 4,274,913 | 6/1981 | Kikuiri et al. | 162/65 |
| 4,451,332 | 5/1984 | Annergren et al. | 162/65 |

FOREIGN PATENT DOCUMENTS

| | | | |
|---|---|---|---|
| 1124015 | 5/1982 | Canada | 162/65 |
| 3017712 | 11/1980 | Fed. Rep. of Germany | 162/65 |

OTHER PUBLICATIONS

Nasman et al., "Medium Consistency Oxygen Bleaching" Tappi, vol. 63, No. 4, Apr. 1980.

*Primary Examiner*—Steve Alvo

*Attorney, Agent, or Firm*—David L. Rae; Larry R. Cassett

[57] ABSTRACT

Wood pulp is bleached in a process which includes passing pulp slurry from a chlorine tower through a washer to a downflow extraction tower which is open to the ambient atmosphere. Caustic and steam are supplied to the extraction tower as is dilution water which is introduced into the lower portion thereof. Oxygen is dissolved in the dilution water which may be at least partially comprised of recycled washer filtrate. This addition of oxygen to the dilution zone of an extraction stage enables the consumption of chemicals such as hypochlorite and/or chlorine dioxide to be reduced while still meeting required levels of pulp brightness and strength. Oxygen may be added to the extraction or other alkaline stages of a bleaching process.

9 Claims, 5 Drawing Figures

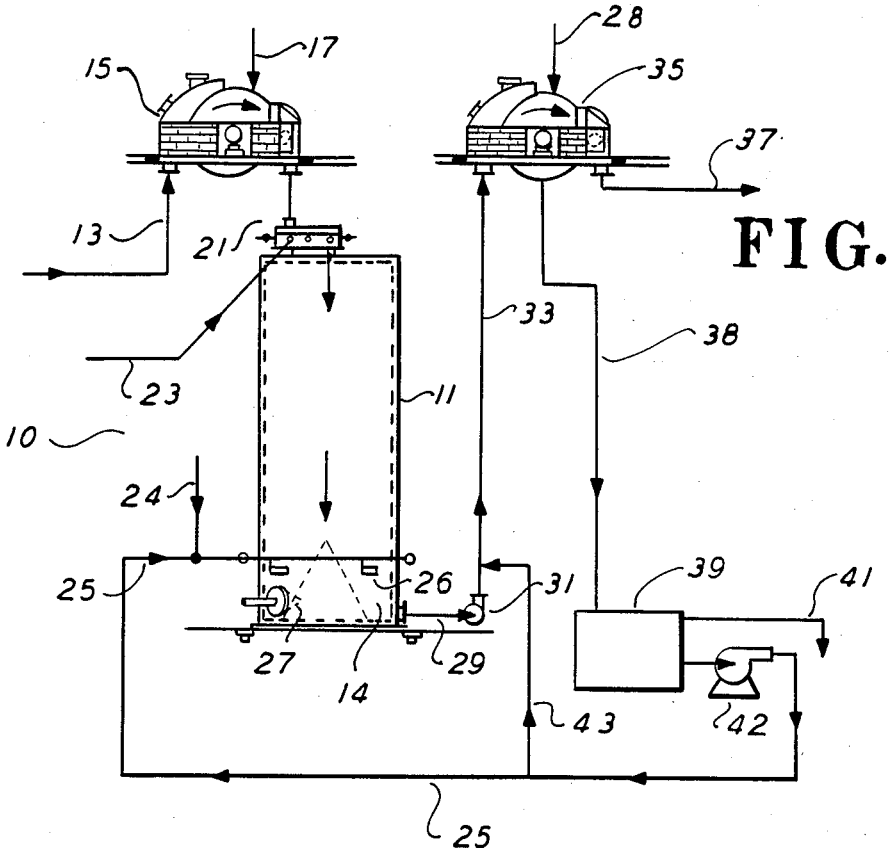
FIG. 1
FIG. 2
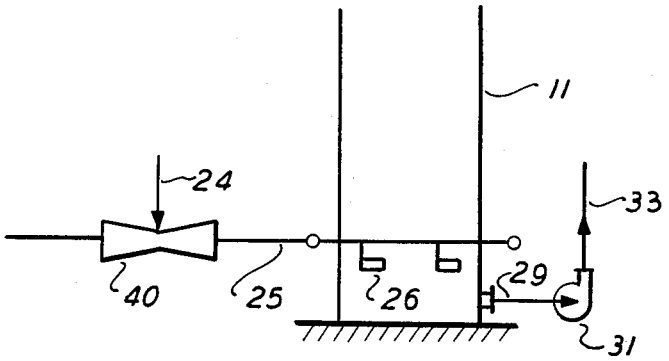

METHOD FOR BLEACHING WOOD PULP INCLUDING DISSOLVING OXYGEN INTO THE DILUTION WATER OF AN EXTRACTION STAGE

BACKGROUND OF THE INVENTION

The present invention relates to improved processes for bleaching wood pulp and more particularly to processes for treating pulp slurry in oxygen-alkali media.

In a conventional chemical pulping process, wood chips are typically supplied to a digester vessel together with a cooking liquor to enable formation of a pulp slurry. In order to produce a pulp suitable for making paper, the pulp slurry formed in the digester is bleached, typically in a chlorine tower and is supplied to an extraction tower wherein delignified materials are removed from the pulp which is then subjected to one or more bleach stages. Commonly, the pulp slurry is washed upon leaving the chlorine tower and the extraction tower, and the filtrate separated from the pulp in the extraction tower washer may be recycled to the extraction tower and introduced into the lower reaches thereof. This recycled filtrate is frequently utilized to dilute the relatively high consistency (10–15%) pulp slurry as the same flows downwardly through the extraction tower. The pulp supplied from the extraction tower to a washer is typically of a relatively low consistency (2–6%) although the pulp leaving the washer is of a higher consistency, e.g. 10% or so. Bleaching is generally achieved in an upflow tower to which chlorine or chlorine dioxide is added. The pulp supplied to the extraction tower is treated under caustic or alkali conditions wherein sodium hydroxide, for example, or other alkali is added so that the delignified materials may be removed from or extracted from the pulp slurry.

In any pulp bleaching process, it is required that properties of the pulp such as burst, tear, viscosity, and freeness are not unduly compromised; yet, the process should be economical to operate in terms of water, steam, chemical consumption, etc. It is known to utilize oxygen in the extraction stage of a pulp delignification process in order to reduce the consumption of chemicals such as chlorine, chlorine dioxide, etc., or with the same consumption of chemicals, to increase delignification or brightness of each unit of pulp so treated. Oxygen-alkali pulp delignification processes have the advantage of tending to discharge fewer chlorine bearing compounds and consequently, tend to reduce the pollutants emitted from a pulp bleaching process. Such a process is described in an article entitled "New Opportunities for Reduction of Pollutants through Process Changes", Tappi Proceeding, March, 1981, which describes the use of oxygen-alkali extraction wherein oxygen and alkali are introduced into a thick stock pulp (8–12% consistency) prior to passage through an upleg tower. The chemical reactions commence in this upleg which is pressurized prior to passing the pulp slurry to a downflow extraction tower. Although the pollutant load and bleach chemical usage may be reduced by use of the process described in this article, significant and costly equipment is required in the form of a high shear mixer and a pressurized upleg which is typically 70–80 feet in height.

It is also known to add oxygen to an alkali extraction stage of a bleaching process as is described in an article entitled "Oxygen-Alkali Extraction; a Versatile Tool Towards a Simplified Bleaching Technique", 1982 International Pulp Bleaching Conference proceeding, pages 17–30. Oxygen is mixed with the pulp in a mixing device and is retained as a gas in the pulp matrix prior to passing with the pulp either upwardly through an upflow extraction tower or upwardly through a pressurized retention leg to enable passage of the pulp through a downflow extraction tower. Pulp consistencies of greater than 10% are utilized, and although this article teaches that the number of bleaching stages may be reduced, relatively expensive mixing devices are required and in some cases an upflow tower may also be necessary. Attempts to delignify pulp in oxygen-alkali environments wherein the capital investment so required is reduced are also described in an article entitled "Medium Consistency Oxygen Bleaching", Tappi Journal, April, 1980, pages 105–109, wherein pulp of 10–15% consistency is subjected to oxygen at relatively high pressures in an effort to reach the same delignification rates as would occur with high consistency pulp. In this process, there is no continuous gas volume in the reactor, and oxygen is transferred directly to cellulose fibers. However, an upflow reactor is required as are retention times of approximately 75 minutes. In addition, other systems for delignifying pulp in oxygen-alkali media are known as, for example, are shown in U.S. Pat. No. 4,198,266, which is assigned to the assignee of the present invention. Each of these prior art systems for delignifying pulp in oxygen-alkali solutions, however, require significant capital costs.

In other prior art processes for bleaching wood pulp, oxygen-alkali solutions are utilized to provide the environment for operation of particular equipment. U.S. Pat. No. 4,177,105 is exemplary of a process for delignifying pulp in oxygen-alkali solutions wherein a relatively complex set of rotating decks are arranged within a treating vessel to which oxygen, caustic and steam are introduced. The oxygen is introduced immediately above a dilution zone in the lower reaches of the treating vessel such that the oxygen passes countercurrently with the downflowing pulp. A pressure of approximately 140 psig is maintained in the vessel, and the reaction between pulp and oxygen is effected over a residence time of approximately 20–90 minutes. U.S. Pat. Nos. 3,832,276 and 3,951,737 also describe processes for delignifying wood pulp in oxygen-alkali environments wherein the pulp is mixed with oxygen and steam and supplied to a high pressure, pre-retention vessel or after such mixing is simply supplied to an upflow bleaching tower. These mixing devices are costly, and in conventional bleach plants, the effluent from the previous stage is at the top of a tower and additional pumps and piping is required to bring such pulp down to the bottom of an upflow tower. Consequently, not all of the processes and apparatus heretofore proposed for improving pulp bleaching processes is either inexpensive or readily adaptable to conventional, current bleaching equipment.

Processes for producing pulp in alkali media from raw materials are known as, for example, is described in U.S. Pat. No. 4,274,913. In this process, alkali cooking liquor and raw cellulose material are supplied to a high pressure vessel in which pressures of 70–350 psig are maintained. The raw material is impregnated with the cooking liquor as it flows downwardly through the vessel and is passed from a cooking zone to a cooling zone before the pulp is diluted in a dilution zone in the lower reaches of the pressure vessel. This reference teaches the addition of alkali and oxygen into the dilution zone through a complex nozzle and rotating scraping blade mechanism in order to establish a countercurrent flow between such oxygen and the downward flowing pulp. Pulp having a consistency of typically 4–10% is removed from the bottom of the pressure vessel. U.S. Pat. No. 4,295,926 also describes equipment for treating pulp with oxygen and essentially relates to a type of mixing device for adequately mixing oxygen gas with the pulp. The mixing device incorporates a plurality of members which pass through the pulp in a direction transverse to the direction of pulp travel and thereby, in accordance with the teachings of this reference, mix oxygen with the pulp. This mixing equipment is, however, relatively complex and costly and is not available at conventional pulping mills. In addition, relatively high pressures on the order of 100 psi are also required in order to effectively mix oxygen and pulp in accordance with the teachings of this reference.

As will be apparent from the foregoing discussion of prior art, processes and apparatus for treating wood pulp, all tend to require additional equipment such as reaction vessels, mixers, upflow legs, etc. In general, the use of an additional upflow leg in conjunction with a downflow extraction tower will require an additional downflow piping system as a typical chlorine stage is embodied in upflow towers, and some means is required to transport such pulp to the bottom of an upflow, preretention tower or leg when the same is utilized. In addition, a further pump and motor is required in order to so transport pulp through additional piping mentioned above. Furthermore, many current, conventional bleach plants simply do not have readily available space for the addition of such additional equipment as noted above. Consequently, although it may be theoretically feasible to retrofit equipment such as upflow legs, additional mixers, etc. to conventional processes, in fact, this is frequently difficult due to space limitations and generally is relatively expensive. Accordingly, there is a need for improved pulp bleaching processes wherein reduced chemical usages are obtainable yet do not require extensive capital equipment additions and their concomitant costs.

OBJECTS OF THE INVENTION

It is an object of the present invention to provide improved pulp bleaching processes.

It is a further object of the present invention to provide improved pulp bleaching processes wherein oxygen is added to an alkaline stage.

It is yet another object of the present invention to provide improved pulp bleaching processes wherein consumption of chemicals such as chlorine, chlorine dioxide, hypochlorite, etc. may be reduced without detrimentally affecting resulting pulp properties.

It is still another object of the present invention to provide improved processes for bleaching pulp that may be utilized in conventional bleach plants with only relatively minor capital equipment additions.

It is still a further object of the present invention to provide improved pulp bleaching processes wherein the consumption of chemicals is reduced yet desired properties such as brightness and viscosity levels are achieved.

Other objects of the present invention will become apparent from the following description of exemplary embodiments thereof which follows, and the novel features will particularly be pointed out in conjunction with the claims appended hereto.

SUMMARY

According to the present invention, an improved pulp bleaching process comprises the steps of passing pulp downwardly through an alkaline stage such as an extraction tower which is exposed to ambient atmosphere, maintaining a temperature in the tower of approximately 40°–80° C., adding alkali to the tower, introducing dilution water into a dilution zone in the tower, and removing diluted pulp from the dilution zone, introducing oxygen into the dilution water such that oxygen is at least partially dissolved therein with the oxygenated dilution water being injected into the tower cocurrently with the flow of pulp therethrough and retained in the dilution zone for an average residence time of less than 5.0 minutes. Various techniques may be utilized for introducing oxygen into the dilution water, such as by simply injecting oxygen gas into a pipe carrying the feed supply of dilution water, i.e. washer recycle filtrate, or introducing oxygen into a venturi through which washer recycle filtrate is supplied to the dilution zone of an extraction stage. Alternately, oxygen may be introduced directly into the dilution water or a sidestream may be removed from the dilution zone, and oxygen may be introduced into this sidestream before the same is returned to the dilution zone. In addition, oxygen may be introduced into the low consistency pulp slurry removed from the dilution zone so that the recycle washer filtrate with oxygen dissolved therein is returned as oxygenated dilution water to the dilution zone.

It has been found that by introducing oxygen into the dilution zone of an extraction stage, as mentioned above, the consumption of chemicals such as hypochlorite, downstream of the extraction stage can be reduced by up to 15–50% or so. This reduction in chemical consumption may be achieved with essentially little additional equipment as extra upflow towers, costly mixing devices and pumps and motors therefor are not required in order to introduce oxygen into the dilution zone of the extraction stage. Furthermore, by utilization of the process according to the invention, desired pulp brightness levels may be readily achieved and improved pulp viscosity is exhibited without adversely affecting other pulp properties. Consequently, the present invention is considered to fulfill a need in the pulp bleaching industry for reduction of operating costs without requiring significant capital or structural additions.

BRIEF DESCRIPTION OF THE DRAWING

The invention will be more clearly understood by reference to the description of exemplary embodiments thereof in conjunctijon with the following drawing in which:

FIGS. 1–5 are partial diagramatic views of apparatus for bleaching pulp by the process according to the invention.

DETAILED DESCRIPTION OF PREFERRED EMBODIMENT

Figure 3:
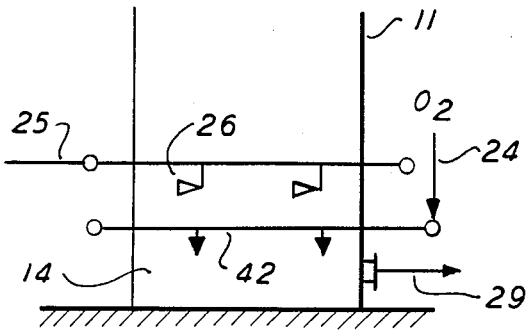

In general, the present invention broadly relates to the dissolution of oxygen in the liquid phase of a pulp slurry in the dilution zone of an alkaline extraction stage. It will be understood that the term "alkaline" stage includes extraction, hypochlorite, peroxide, etc. towers or stages. For purposes of convenience, alkaline stages will be referred to extraction stages or towers.

In a typical pulp bleaching mill, pulp is supplied to a bleaching tower in which it is exposed to chlorine or a chlorine-based compound such as $ClO_2$, hypochlorite, etc. and is then supplied to a washer before it is introduced into an extraction stage. Alkali conditions are maintained in the extraction stage which is typically a covered tower through which the pulp is caused to flow downwardly and from which the pulp is supplied to a washer before passing to the next chlorine stage for further delignification. Although the tower is covered, the top of the tower is exposed to ambient pressure. Typical bleaching sequences are CEHDED or CEDED wherein C is a chlorine stage, E is an extraction stage, H is a hypochlorite stage and D is a chlorine dioxide stage. As noted above, oxygen-alkali (OE) extraction stages have been proposed and are described in the prior art.

In accordance with the invention, an extraction stage is adapted to receive a downflow of pulp, typically from a washer which receives such pulp from an earlier chlorine delignification stage. The consistency of pulp supplied to the extraction stage is typically 8–14% and a suitable mixing device is utilized for adding necessary steam and alkali to the pulp prior to entering the extraction stage tower. The pulp will typically require one hour or so to flow through the complete extraction stage, although the residence time of pulp will be determined upon its volumetric flow rate. The lower portion of the extraction stage is comprised of a dilution zone in which the pulp is diluted to a consistency of approximately 1.0–5.0%. This is common in conventional pulp bleach mills as a technique for preparing the pulp for subsequent washing. Dilution water is added to the dilution zone by means of nozzles which are in communication with a manifold that extends around the lower portion of the extraction tower and mining nozzles are utilized to emit dilution water into the dilution zone, typically in a cocurrent direction with the flow of pulp therethrough. Commonly, the dilution water is comprised of filtrate separated from the washer which receives pulp from the extraction tower and fresh shower water. The washer filtrate is returned to the dilution zone in order to conserve water. The average residence time of pulp in the dilution zone, in accordance with the invention, is approximately 2.5–3.0 minutes and preferably less than about 5.0 minutes based upon a volumetric flow rate of pulp through the entire extraction stage. Oxygen is preferably introduced into the dilution water or recycled washer filtrate prior to its introduction into the dilution zone and the oxygenated dilution water is supplied to the dilution zone cocurrently with the flow of pulp. Preferably, sufficient pressure is applied to the oxygen so that it will pass through the pipe carrying dilution water at a turbulence which is effective to dissolve oxygen therein. The level of turbulence should exhibit a Reynolds Number of 10,000 although no additional mixing elements are required to generate the necessary turbulence. In addition, there is essentially no solid gas contact between oxygen and pulp fibers as the oxygen is dissolved in the dilution water prior to reacting with constituents in the pulp slurry.

The extraction stage according to the invention is essentially a vessel which is exposed to ambient atmosphere and is typically provided with mining nozzles in a dilution zone as mentioned above. During extraction of pulp, temperatures are typically about 40°–80° C. and there is no need to apply superatmospheric pressure to the pulp in the extraction stage. It has been found in actual pulp mill trials that the nozzles mentioned above and introduction of oxygenated dilution water into the extraction stage does not result in any undue channelling therein nor adversely affect pulp properties. On the contrary, desired pulp brightness levels are met in the bleaching process with reduced consumption of chemicals such as hypochlorite, etc. and improved, i.e. higher, pulp viscosities have been measured. Furthermore, by introducing oxygenated dilution water into the extraction stage, oxygen is permitted to react with a relatively low consistency pulp which is a less intensive mixing operation than is mixing oxygen in the gaseous phase directly with pulp fibers as, for example, is described in U.S. Pat. No. 4,295,926. The particular location of oxygen injection into the dilution water may be one of several as noted above and no costly mixing or injection equipment is required to thereby introduce oxygen into the dilution zone. Accordingly, the desired result of achieving predetermined pulp bleaching characteristics with reduced chemical consumption does not require excessive or costly capital additions as is required in prior art pulp bleaching systems.

As mentioned above, the process according to the invention enables the consumption of chemicals required to bleach pulp to a desired extent to be reduced. Typically, chemicals such as chlorine and chlorine dioxide utilized primarily for delignification will be set at desired flow rates as will the rate at which a caustic (NaOH) is supplied to an extraction stage. Subsequently, upon introducing oxygenated liquid to the dilution zone as described above, pulp may be sampled at any desired downstream location so that the brightness and other properties of the pulp may be measured and compared with predetermined desired values. It has been found that the flow rate of hypochlorite, for example, supplied to a third extraction stage may be reduced while still enabling desired pulp brightness levels to be obtained upon oxygenating dilution water in the first extraction stage in accordance with the invention. These reductions in hypochlorite flow rates have been found to be approximately 15–50% and, for example, have resulted in reductions of hypochlorite on pulp from approximately 1.5% to 1.0–1.20% as active chlorine per ton of pulp. Alternately, in the event it is desired to obtain higher brightness levels of the bleached pulp, the flow rate of all chemicals, including hypochlorite, may be maintained at previous levels while oxygenated dilution water is supplied to the dilution zone of, for example, the first extraction stage. The flow rate of chemicals such as hypochlorite may be adjusted manually or automatic control systems may be utilized although the cost of such systems may not be justified in all instances. In short, the control over and ability to reduce the flow rate of chemicals such as hypochlorite to a pulp bleaching mill may be readily achieved without requiring any significant additional capital equipment.

It has been found that upon adding oxygen to the dilution zone of an extraction stage as described above, there will be a delay upon commencement of oxygen addition and the point in time at which bleached pulp evinces higher brightness levels. Thus, it has been found necessary to supply oxygen to the dilution zone as mentioned above for periods of approximately 8–36 hours before brightness levels will increase to a point such that the addition of downstream chemicals such as hypochlorite can be reduced and yet enable desired brightness levels to be attained. Although the precise reactions taking place in the dilution zone upon introduction of oxygen as described above are not fully understood, it is believed that the oxygen initially rapidly reacts with organic compounds of the pulp slurry and thus satisfies its chemical oxygen demand. By virtue of recycling washer filtrate to the dilution zone, as will be described in detail hereafter, the consumption of oxygen by organic compounds tends to level off and after the aforementioned delay, oxygen additions enable hypochlorite reductions to be achieved while still obtaining desired brightness levels. As oxygen is consumed quickly initially in the dilution zone, even in a steady-state operation, it has been found that long residence times, i.e. 20 minutes to one hour or greater, of oxygen in the extraction stage is not required to enable the aforementioned reductions in chemical flow rates to be achieved. It is believed that oxygen introduced into the dilution zone is effective to permit chemicals downstream of the extraction stage to which oxygen is supplied to react more fully with the pulp rather than with compounds dissolved in or carried by the filtrate. Consequently, it is believed that the process according to the invention enables a more effective reaction to occur between such chemicals as hypochlorite and the pulp than would occur in the absence of adding oxygen to the dilution zone as described above. The effect of oxygen additions remains after oxygen supply is terminated and this effect may last for about 8 hours or so.

In addition to the aforementioned reductions in chemical consumption, it has been found that the process according to the invention will enable the viscosity of pulp to be increased. The significance of increased viscosity is that the average degree of polymerization of cellulose in the pulp is greater and that degradation of the pulp caused by the bleaching process is reduced. Consequently, increased viscosity of the pulp indicates less damage to the pulp and is a desirable resulting attribute of the process according to the invention.

Referring now to FIG. 1, illustrated therein is an exemplary embodiment of apparatus for practicing the process according to the invention which apparatus 10 is generally comprised of an extraction tower 11, washers 15 and 35 and associated pumps and conduits which will now be described. Extraction tower 11 may take the form of a conventional tower which is suitable for retaining wood pulp and, for example, may be approximately 7 to 8 feet in diameter and approximately 70 feet in height. A conduit 13 is provided for delivering wood pulp slurry, preferably from a previous bleaching stage to a washer 15 which is supplied with water through conduit 17. The washer may comprise a conventional vacuum drum or filter in which a vacuum is supplied to the interior of the drum thereby retaining pulp against the outer screened surface to enable pulp to be washed by water supplied through conduit 17. The consistency of the pulp leaving washer 15 is approximately 10%, and this pulp is supplied to a mixer 21 to which steam is added through conduit 23. The pulp is supplied from mixer 21 into the upper reaches of extraction tower 11 and is caused to flow downwardly therethrough. Alkali is added to extraction tower 11, and this may be done in any convenient form. The lower portion 14 of extraction tower 11 comprises a dilution zone to which water, which may be in the form of vacuum washer filtrate is supplied through conduit 25 and is ejected through a set of mining nozzles 26 in a generally downward direction cocurrent with the flow of pulp slurry through tower 11. Oxygen is preferably added through conduit 24 to this dilution water which is introduced as oxygenated water into dilution zone 14. The turbulence generated upon ejecting dilution water from nozzles 26 is effective to cause a rapid mixing of this dilution water with the pulp in the dilution zone and thereby promote reactions between dissolved oxygen and organic compounds in the pulp slurry. The consistency of the pulp is reduced from a level of approximately 8–14% in the upper reaches of extraction tower 11 to approximately 1.5–4% in the dilution zone. A circulator 27 may be utilized to promote turbulence and mixing of pulp and dilution water in dilution zone 14. The pulp slurry, which is now of relatively low consistency, is removed from dilution zone 14 through conduit 29. Pump 31 is effective to supply this removed, low consistency pulp through conduit 33 to a further washer 35. Pulp is removed from washer 35 through conduit 37 for further treatment and the filtrate recovered from washer 35 is supplied through conduit 38 and a seal tank 39. Pump 42 is effective to recycle this filtrate to dilution zone 14 through conduit 25 and to conduit 33 through conduit 43. By supplying filtrate to conduit 33, the consistency of the pulp supplied to washer 35 may be controlled at a desired value, say 0.5–1.0%. An overflow line 41 is provided with tank 39. Washer 35 receives fresh water through line 28.

With respect to the apparatus illustrated in FIG. 1, it is noted that all of this equipment is typically presently utilized in conventional bleach plants and that the only structural addition necessary to supply oxygen to the dilution zone is conduit 24 which is placed in communication with conduit 25. Thus, in order to bleach pulp by a process according to the invention, relatively little in the way of equipment modifications are required, and no new rotating equipment such as pumps, mixers, washers, etc. are required.

Referring now to FIG. 2, illustrated therein is a further embodiment of apparatus for bleaching pulp in accordance with the invention. The structure illustrated in FIG. 2 is essentially identical to corresponding structure illustrated in FIG. 1 except that a venturi 40 may be utilized as a means of dispersing oxygen in recycled dilution water, i.e. washer filtrate. Alternately, oxygen can be sparged into conduit 25 through a conventional sparger or the like. Dilution water is introduced through nozzles 26 in a downward direction and cocurrently with the flow of pulp through extraction tower 11.

Figure 4:
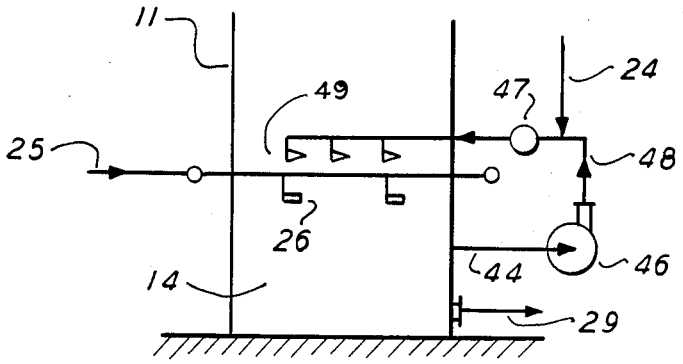

In FIG. 3, oxygen is supplied through conduit 24 to a manifold and nozzle arrangement 42 such that oxygen may be introduced directly into dilution zone 14 of extraction tower 11. FIG. 4 shows a further embodiment of apparatus for bleaching pulp in accordance with the invention wherein a sidestream of pulp is removed from dilution zone 14 through conduit 44 by means of a pump 46 and is returned to the upper portion of the dilution zone through conduit 48 and nozzle 49. Oxygen which is supplied through conduit 24 is introduced into and mixed by means of static mixer 47 with the recycled low consistency pulp slurry being returned through conduit 48 into extraction tower 11. In this apparatus, dilution water is still supplied through conduit 26 and is directed into extraction tower 11 to thereby augment the downflow of pulp there through.

Figure 5:
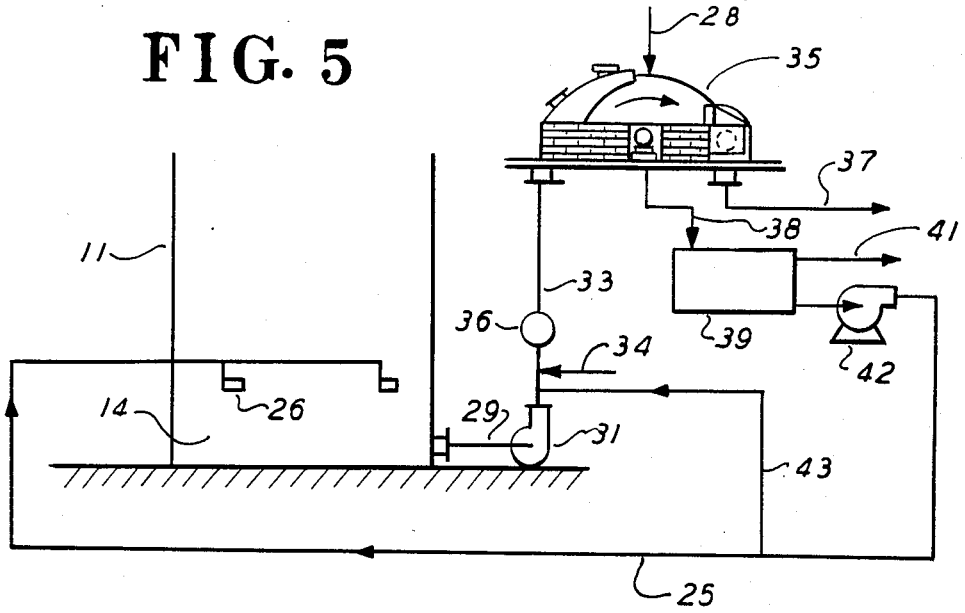

FIG. 5 illustrates a further embodiment of apparatus for practicing the process according to the invention. The pulp slurry removed from dilution zone 14 through conduit 29 is pumped by means of pump 31 through conduit 33 to washer 35. Oxygen is injected through conduit 34 into conduit 33, and by means of static mixer 36 disposed in conduit 33, oxygen is dissolved in the liquid phase of the slurry. As most of this liquid phase is recycled as washer filtrate through line 25, as dilution water, through conduit 38, tank 39, pump 42, an oxygenated dilution water is returned to dilution zone of tower 14. A portion of washer filtrate is supplied to conduit 33. Pulp slurry of about 10% consistency is removed from washer 35 through conduit 37. Overflow line 41 is provided with tank 39.

The pulp bleaching process according to the invention has been experimentally tested on southern kraft softwood and hardwood by a C/DEHDED sequence. Oxygen was added to the dilution zone of the first extraction stage in a manner as illustrated in FIG. 1. Oxygen was supplied at the rate of 4000 lb. per day while the pulp flow rate through the extraction tower was nominally rated at 600 tpd. The rate of oxygen consumption with respect to pulp varied from 0.1 to 0.9% on pulp with an average figure of 0.4%. Chemical usage was determined from hourly recorded figures while brightness and viscosity readings were taken at the final stage of the bleach process. The results of this testing, both with and without oxygen addition, is set forth below with regard to soft wood in Table 1 and with regard to hard wood in Table 2.

TABLE 1

| | NaOCl | $ClO_2$ | Viscosity | Brightness |
|---|---|---|---|---|
| Without oxygen | 1.51% | .62% | 26.3 | 88.6 |
| With oxygen | 1.21% | .58% | 37.8 | 89.1 |

TABLE 2

| | | | | |
|---|---|---|---|---|
| Without oxygen | .901% | .476% | 38.5 | 88.3 |
| With oxygen | .733% | .414% | 40.6 | 88.9 |

It will be seen that the consumption of hypochlorite utilized in bleaching soft wood was reduced by approximately 0.30% on pulp and reductions of chlorine dioxide were approximately 0.04%. The viscosity of the pulp softwood increased from approximately 26.3 to 37.8 with the use of oxygen. The target value of brightness for the grade of pulp bleached during this test was 89.0 which was attained upon utilizing oxygen in accordance with the invention. Viscosity was measured in units of centipoise while brightness was measured in units of % GE. The percentages of hypochlorite and $ClO_2$ are represented as the % of active chlorine on pulp.

The experimental testing of the process according to the invention on kraft hardwood as indicated in TABLE 2 resulted in a savings of hypochlorite of approximately 0.17% on pulp and a savings of approximately 0.06% chlorine dioxide. A slight increase in viscosity was noted upon utilization of oxygen while the dirt count was also slightly reduced. Achieved brightness was essentially on target as a brightness figure of 88.9 was attained.

The data set forth above in Tables 1 and 2 is comprised of hourly average values, although the data obtained does indicate significant reductions in hypochlorite and chlorine dioxide while not detrimentally affecting other properties of the pulp. In cases of viscosity, some actual improvement has been noticed. There was no change made to normal flows of caustic and steam utilized in the extraction stages of this plant.

In summary, the process according to the invention enables wood pulp to be bleached to acceptable criteria with a reduction in the chemicals required, i.e. chlorine dioxide, hypochlorite, etc. without requiring any significant equipment modifications to existing extraction stages. This beneficial result is achieved by introducing oxygenated dilution water into the dilution zone cocurrently with the downflow of pulp through the extraction stage. This mixing of oxygen, dilution water and pulp is achieved in a relatively low consistency pulp slurry and has been found effective even though the residence time of oxygenated dilution water in contact with the dilution zone is relatively short, i.e. less than about 5.0 minutes. Consequently, the resulting mixing of oxygen and dilution water and pulp is achieved in relatively low consistency mixing which averts the need for complex, expensive specially adapted mixing devices and yet is effective to enable chemical reductions to be obtained as noted above. Furthermore, no special or extraordinary conditions such as higher than normal temperatures and pressures existing in the extraction stage are required so that reductions in chemical consumption are not obtained at the expense of significant capital additions to a bleach mill.

The foregoing and other various changes in form and details may be made without departing from the spirit and scope of the present invention. Consequently, it is intended that the appended claims may be interpreted as including all such changes and modifications.

I claim:

1. A method for bleaching wood pulp wherein said pulp is passed as a slurry downwardly through an extraction stage in the form of a tower the top of which is exposed to ambient conditions and which has a dilution zone in the lower portion thereof comprising the steps of adding alkali to said stage; maintaining the temperature of pulp in said stage between approximately 40°–80° C., introducing dilution water into said dilution zone and introducing oxygen into said dilution water to thereby at least partially dissolve said oxygen in said water with the oxygenated dilution water being introduced into said stage generally cocurrently with the flow of said pulp therethrough, and retaining said pulp slurry in said dilution zone for an average residence time of less than approximately 5.0 minutes prior to removal from said tower, wherein the oxygen is introduced in an amount effective to increase the viscosity of the bleached pulp.

2. The method defined in claim 1 additionally comprising the steps of washing the pulp slurry removed from said extraction stage in a washer and separating a washer filtrate from said pulp slurry.

3. The method defined in claim 2 wherein the step of introducing dilution water comprises recycling said washer filtrate to said dilution zone.

4. The method defined in claim 1 wherein the residence time of said pulp slurry in said dilution zone is approximately 2.5–3.0 minutes or less.

5. The method defined in claim 1 wherein the step of introducing dilution water into the dilution zone comprises passing said dilution water through a venturi prior to passing said water into said dilution zone and injecting oxygen into said venturi to mix with, and at least partially dissolve in, said dilution water.

6. The method defined in claim 1 wherein the step of introducing oxygen into said dilution water comprises introducing oxygen gas into said dilution zone whereby said oxygen gas is at least partially dissolved in said dilution water.

7. The method defined in claim 1 wherein the step of introducing oxygen into said dilution water comprises removing a sidestream from said dilution zone, injecting oxygen into said removed sidestream whereby said oxygen is mixed with and at least partially dissolved in said removed sidestream and returning said oxygenated sidestream into said dilution zone.

8. The method defined in claim 1 additionally comprising the step of passing said removed pulp slurry to a washer and wherein the step of introducing oxygen into said dilution water comprises injecting oxygen into said removed pulp slurry before the same is supplied to said washer.

9. The process defined in claim 8 additionally comprising the step of separating a washer filtrate from said pulp slurry and wherein the step of introducing dilution water comprises recycling said washer filtrate to said dilution zone.

* * * * *